United States Patent [19]

Huber

[11] 4,134,094

[45] Jan. 9, 1979

[54] FUSE ELEMENT

[75] Inventor: William J. Huber, Racine, Wis.

[73] Assignee: McGraw-Edison Company, Elgin, Ill.

[21] Appl. No.: 793,844

[22] Filed: May 5, 1977

[51] Int. Cl.[2] ..... H01H 85/06; H01H 85/08

[52] U.S. Cl. ..... 337/292; 337/159; 337/161

[58] Field of Search ..... 337/162, 161, 160, 159, 337/163, 164, 165, 166, 292, 296, 293, 158

[56] References Cited

U.S. PATENT DOCUMENTS

| | | | |
|---|---|---|---|
| 2,816,989 | 12/1957 | Sugden | 337/292 |
| 3,140,371 | 7/1964 | Johann et al. | 337/296 |
| 3,571,775 | 3/1971 | Kozacka | 337/161 |

FOREIGN PATENT DOCUMENTS

| | | |
|---|---|---|
| 614615 | 12/1948 | United Kingdom. |
| 1213736 | 11/1970 | United Kingdom. |

*Primary Examiner*—Harold Broome
*Attorney, Agent, or Firm*—Thomas E. McDonald; Jon Carl Gealow; Ronald J. LaPorte

[57] ABSTRACT

A fusible element for a current limiting fuse includes two silver ribbons, each provided with a plurality of holes spaced apart along the length thereof which define fusible points of reduced cross sectional area, one of these ribbons including a conventional "M" spot consisting of a body of low melting temperature alloy such as tin-lead solder, in intimate contact with the silver ribbon. One end of each of the silver ribbons is joined to a respective end of a centrally disposed tin wire element by a copper interconnecting member. This tin wire central portion of the fusible element has a melt $I^2t$ which is equal to or greater than that of the silver ribbons in series with it. The time-current characteristics of this fusible element at high magnitude fault currents and at low magnitude overload currents are determined respectively by the fusible points of reduced cross sectional area of the silver ribbons and by the "M" spot of one of the silver ribbons in the same way as in the fusible elements of known current limiting fuses. However, at intermediate fault currents, the tin element initiates melting of the fusible element much faster than a fusible element using only a perforated silver ribbon and a conventional "M" spot.

5 Claims, 6 Drawing Figures

FUSE ELEMENT

BACKGROUND OF THE INVENTION

1. Field of the Invention

The present invention relates to fuses and, more particularly, to a fusible element of a high voltage current limiting fuse.

2. Description of the Prior Art

Current limiting fuses, such as that disclosed in U.S. Pat. No. 3,243,552, issued Mar. 29, 1966, to H. W. Mikulecky, conventionally comprise one or more fusible elements, each having a plurality of fusion points distributed along its length and embedded in an inert granular arc quenching material such as sand or finely divided quartz. Usually these fusible elements are in the form of thin silver ribbons having serially related portions of relatively small cross sectional area which determine the points where fusion of the fusible element is initiated on high magnitude fault currents. For example, the silver ribbons may be provided with a plurality of circular, spaced apart, perforations which determine these fusion points. When these fusible elements are subjected to high magnitude fault currents, all of the portions of small cross sectional area fuse or vaporize almost simultaneously, resulting in the formation of arclets in series which control the transient voltage across the fuse elements. The metal vapors at these fusion points rapidly expand to many times the volume originally occupied by the fusible element and are thrown into the spaces between the granules of inert filler material where they condense and are no longer available for current conduction. The current limiting effect results from the interaction of the metal vapors and the inert granular material surrounding the fusible element. The physical contact between the hot arc and the relatively cool granules causes the rapid transfer of heat from the arc to the granules, thereby dissipating most of the arc energy with very little pressure build-up within the fuse enclosure. The vapors of silver have relatively low conductivity unless their temperature is particularly high, and the temperature of the silver vapors is rapidly reduced by the sand filler until the vapors will not support a flow of current. The quartz sand particles, which are in the immediate vicinity of the arc, fuse and become partial conductors at the high temperature of the arc and form a fulgurite, or semiconductor. The fulgurite resulting from fusion and sintering of the quartz sand particles is in the nature of a glass body, and as it cools it loses its conductivity and becomes an insulator.

Generally, the fusible elements of high voltage current limiting fuses also include an "M" spot along a central portion of the fusible element to determine the time-current melting characteristics of the fuse when it is subjected to a low magnitude fault or overload current. This "M" spot is generally in the form of a bead of low melting temperature alloy such as tin-lead solder which is in intimate contact with the fusible silver ribbon. When a low magnitude overload current flows for a long period of time, the silver ribbon becomes hot enough to melt this alloy bead, and the amalgamation of the silver and the alloy bead produces a eutetic solid solution having a much lower melting temperature than that of pure silver, with high enough resistance to melt the ribbon at this point. This amalgamation process is very effective at long melting times, but at shorter times it is very slow responding. Consequently, at intermediate melting times, in the range of 0.1 to 1,000 seconds, these current limiting fuses do not coordinate very well with other types of overcurrent devices, such as cutouts and reclosers which have more inverse time-current characteristics in this range.

SUMMARY OF THE INVENTION

Therefore, it is an object of this invention to provide a current limiting fuse having improved time-current characteristics for better coordination with other types of overcurrent interrupting devices.

It is a further object of the invention to provide a fusible element for current limiting fuses which includes dual sensing characteristics wherein each characteristic responds to the desirably controls a specific part of the time-current characteristics of the fuse. It is a related object of the invention to provide a fusible element for current limiting fused having sections for respectively determining the time-current characteristics of the fuse in a high range and an intermediate range of overcurrents, and an "M" spot for determining the time-current characteristics of the fuse at low overcurrent values.

In a preferred embodiment of the invention, each fusible element includes two end sections of thin silver ribbon, which are connected together in series through an intermediate overcurrent sensing assembly. Each of these silver ribbons includes fusion points of relatively small cross sectional area at which fusion of the fusible element is initiated when the fuse is subjected to a high magnitude overcurrent. The intermediate overcurrent sensing assembly includes a current carrying center section of low melting temperature material, such as tin, which has a melt $I^2t$ equal to or greater than that of the silver ribbon end sections of the fusible element. This center section of low melting temperature material is soldered at either end to a respective copper connecting section, which in turn is connected to a respective one of the two silver ribbon end sections of the fusible element. The center section of low melting temperature material has a higher thermal impedance from its midpoint to the copper connecting sections and to the adjacent inert granular material than do the silver ribbon fusion points of relatively small cross sectional area to the adjacent silver ribbon portions of relatively large cross sectional area and to the adjacent granular material. One of the silver ribbon end sections of this fusible element includes a conventional "M" spot, consisting of a body of low melting temperature alloy such as tin-lead solder, which amalgamates with the silver ribbon at low overcurrents of prolonged duration.

At a high magnitude overcurrent, fusion will be initiated at the fusion points of the silver ribbon end sections, either before, or simultaneously with, the center section of low melting temperature material. At a lower, intermediate overcurrent, because of the higher thermal impedance of the center section, fusion will be initiated at the midpoint of this center section. Finally, at the lowest range of overcurrents, the fusible element first melts open at the "M" spot on one of the silver ribbon end sections.

BRIEF DESCRIPTION OF THE DRAWINGS

A more complete understanding of the invention may be had by referring to the accompanying detailed description of the invention and drawings in which.

DESCRIPTION OF PREFERRED EMBODIMENTS

Figure 1:
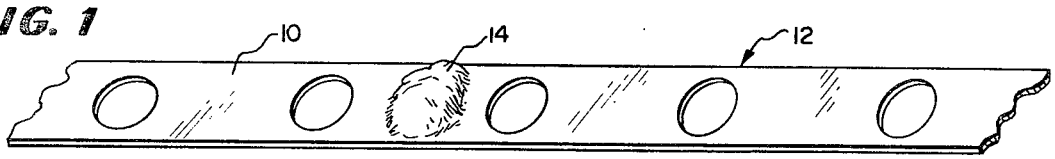
FIG. 1 is a partial perspective view of a fusible element of a current limiting fuse, which includes a known type of "M" spot.

Referring now to FIG. 1, a thin silver ribbon fusible element 10 of a current limiting fuse includes a plurality of spaced apart circular perforations which determine the fusion points 12 of minimum cross sectional area where fusion of this element 10 is initiated by high magnitude overcurrents. A bead 14 of low melting temperature alloy such as tin-lead solder is disposed on the silver ribbon 10 at approximately the midpoint of the ribbon. At low overcurrents flowing for prolonged periods, the fusible ribbon 10 becomes hot enough to melt the alloy body 14, and the amalgamation of the silver and the alloy body 14 produces a eutectic solid solution having a much lower melting temperature than that of pure silver, with high enough resistance to melt the ribbon 10 at this point. This "M" spot construction allows the fusible ribbon 10 to melt at a temperature in the 400–600° F. range when subjected over a long period of time to low magnitude overcurrents, as compared to the normal melting temperature of 1760° F. for silver.

Figure 2:
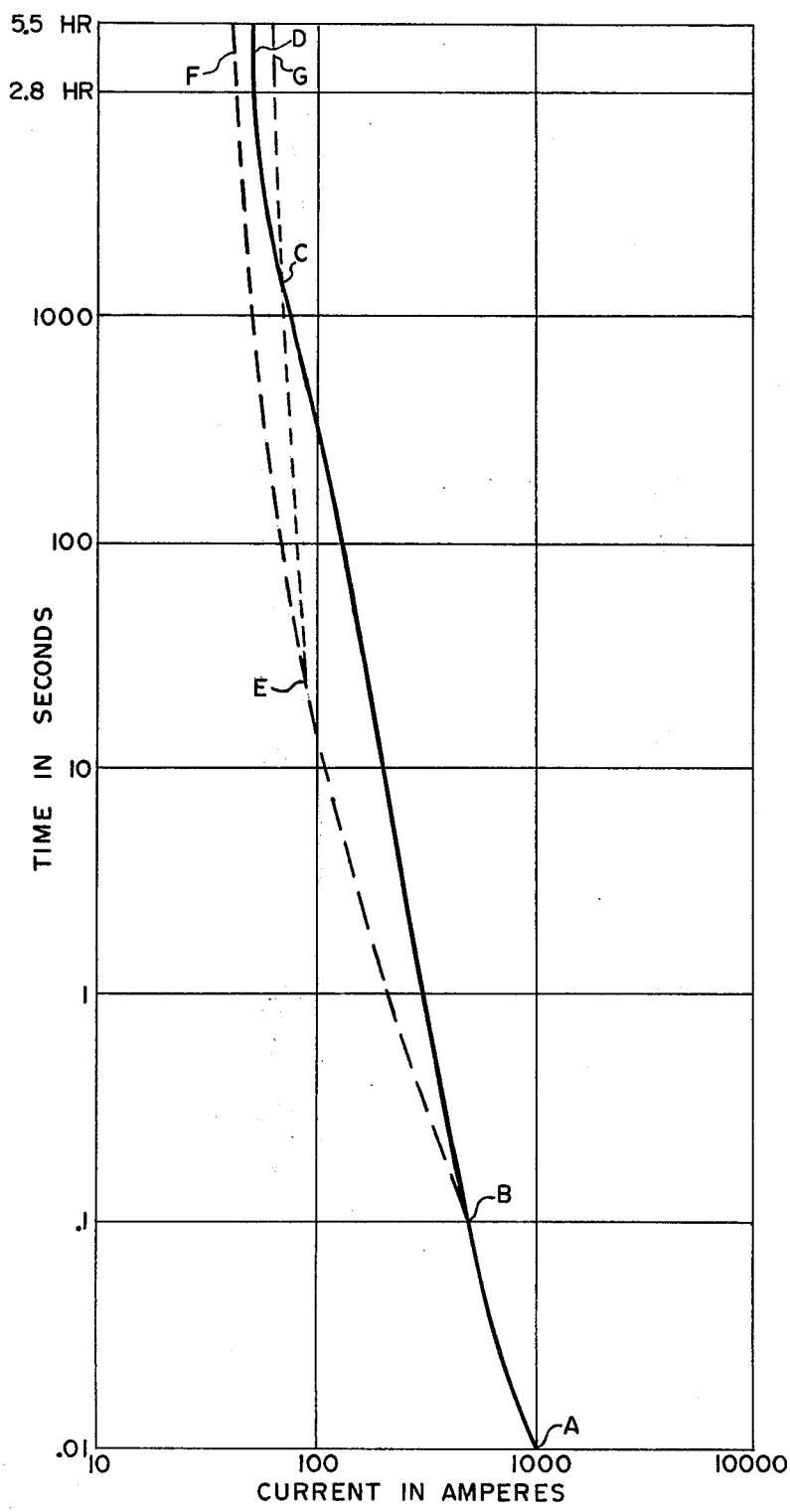
FIG. 2 is a graph illustrating the time-current characteristics of the fusible element embodiments of FIGS. 1, 4–6.
Figure 3:
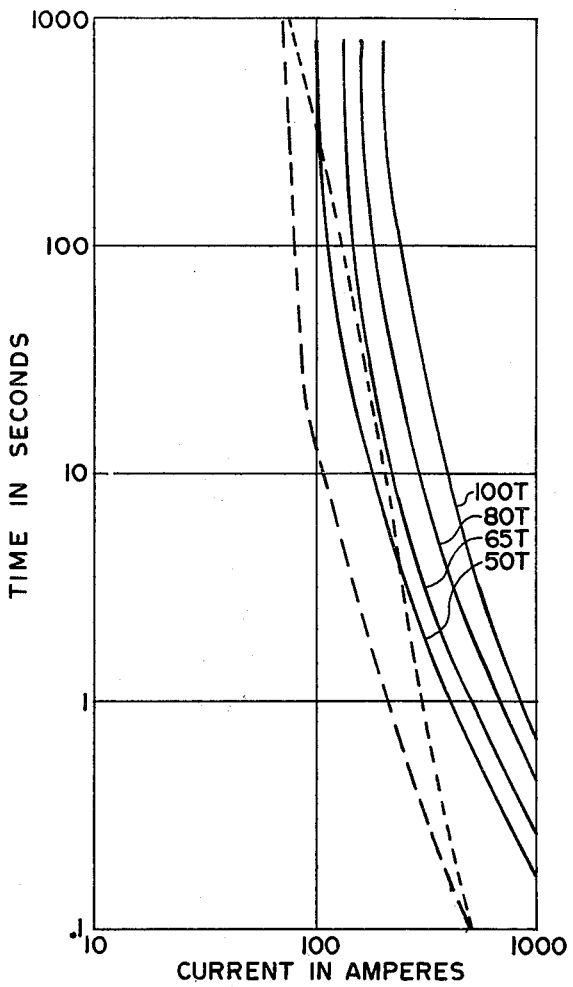
FIG. 3 is a graph of the minimum melting time-current characteristics of conventional current limiting fuses and the current limiting fuse disclosed herein, as well as standard type fuse links to illustrate coordination of these fuses.

The minimum melt time-current characteristics of a 40-ampere current limiting fuse having fusible elements similar to that of FIG. 1 is shown by the solid curved line A-B-C-D of FIG. 2, and also by the curve of short dashed lines in FIG. 3. FIG. 3 also includes the standard A.N.S.I. minimum melt time-current characteristic curves, shown by solid lines, for T-type fuse links of the ratings of 50, 65, 80, and 100 amperes. As can be readily seen from FIG. 3, a 40-ampere fuse using the conventional fusible element of FIG. 1 can only coordinate with fuse links 80T and larger.

Figure 4:
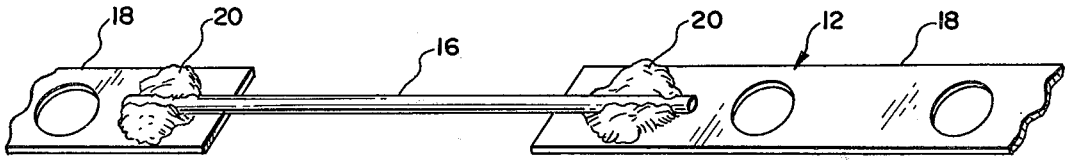
FIG. 4 is a partial perspective view of a fusible element of a current limiting fuse which includes a central current carrying portion of low melting temperature material, soldered at each end to silver ribbon portions to form "M" spots at these junctures.

The fusible element of a current limiting fuse can be constructed, as shown in FIG. 4, to have a more inverse minimum melt time-current characteristic curve in an intermediate portion of the curve, to provide better coordination with other overcurrent devices, by connecting a link 16 of low melting temperature conductive material, such as tin, between two sections of silver ribbon 18, identical to the silver ribbon 10 of FIG. 1. The link 16 is electrically connected at each end to a respective silver ribbon 18, for example, by soldering. Inherent "M" spots 20 are thus formed at the juncture of the link 16 and each silver ribbon section 18. The cross sectional area of the link 16 is chosen so that it has a melt $I_2t$ which is equal to or greater than that of the silver ribbon 18, to thus assure that the fusion points of the silver ribbon sections 18 will open at a high magnitude overcurrent before or simultaneously with the link 16. It has been found that the greatest shift in the time-current characteristic curve is obtained when the melt $I^2t$ of the link 16 is just equal to that of the ribbon sections 18. Thus the cross sectional area of a tin link 16 preferably should be 5.05 times as large as the minimum cross sectional area of the silver ribbon sections 18. Also, the link 16 is constructed to have a greater thermal impedance than any fusion point 12 of the silver ribbon sections 18, so that the link 16 has less ability to dissipate heat to the inert granular material surrounding it or to the cooler areas of the silver ribbon 18 to which it is connected than the fusion point 12 has to dissipate heat to the cooler adjacent portions of large cross sectional area of the ribbon 18 or the surrounding inert granular material. To accomplish this, the link 16 can have a circular cross sectional shape to minimize the radiating surface in contact with the surrounding granules of sand or other inert material, and the link 16 can be relatively long in comparison to the length of one of the fusion points of the ribbon sections 18. Also, the center portion of the link 16 could be enclosed in a thermal insulating material to retain heat therein.

Referring now to FIG. 2, the minimum melt time-current characteristics of a 40-ampere current limiting fuse having fusible elements similar to those shown in FIG. 4 will be determined by the minimum melting times of the fusion points 12 of the ribbon sections 18 for high magnitude overcurrents, in the same way as these minimum melting times are determined for a current limiting fuse having fusible elements according to FIG. 1, as shown by the curve portion A-B in FIG. 2. However, at lower overcurrents, the fusion points 12 of the ribbon elements 18 will dissipate the heat produced by these overcurrents more effectively than will the link 16, and the link 16 will melt open the fuse element faster than the fusion points 12 of the silver ribbon sections 18, as shown in the dashed line curve portion B-E, in FIG. 2. At still lower overcurrents, the link 16 will effectively dissipate the heat generated therein but the inherent "M" spots 20 will amalgamate with the adjacent silver ribbon 18 to form a high resistance alloy therewith and open these ribbons 18 at this point, as illustrated by the dashed line curve portion E–F, of FIG. 2. Thus a fusible clement constructed as shown in FIG. 4 will result in a more inverse minimum melt time-current characteristic curve A-B-E-F than that produced by the fusible element of FIG. 1 (A-B-C-D, in FIG. 2).

The minimum melting current of the fusible element shown in FIG. 4 is less than the minimum melting current for the conventional fusible element shown in FIG. 1, primarily because very little of the fault current flows through the "M" spot body 14 of the fusible element of FIG. 1, whereas all of the current flowing through the fusible element of FIG. 4 flows through the inherent "M" spots 20 connecting the link 16 to the respective silver ribbons 18. As shown in FIG. 2, the minimum melting current for a 40-ampere current limiting fuse using the conventional "M" spot 14 construction of FIG. 1 is 50 amperes, whereas the minimum melting current for a 40-ampere current limiting fuse using the "M" spot 20 construction of FIG. 4 is only 42 amperes. This minimum melting current of 42 amperes is much too close to the 40-ampere continuous current carrying rating of the fuse, so that in effect, this fuse would have a lower continuous current carrying rating, thus somewhat nullifying the effect of the faster melting times in the intermittent range from 0.1 to 1,000 seconds. Also, the minimum melt current could not be increased by enlarging the tin link 16 without losing the fast melting times in this intermittent range.

Figure 5:
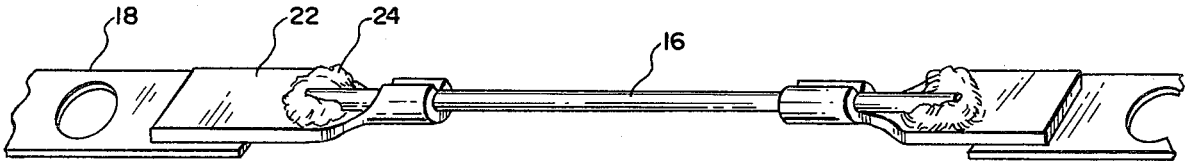
FIG. 5 is a partial perspective view of a fusible element of a current limiting fuse, illustrating the intermediate overcurrent sensing assembly disclosed herein.

However, the fusible element of FIG. 4 can be modified to achieve a higher minimum melt current while still mantaining the fast melting times in the intermediate range necessary for proper coordination with other devices by eliminating the inherent "M" spots 20 at the junctions of the tin link 16 and the silver ribbons, 18. This is achieved by disposing a copper connecting member 22 having the same cross sectional area as the silver ribbons 18 between each end of the tin link 16 and the silver ribbon sections 18, as illustrated in FIG. 5. In such a construction, the "M" spots 20 at the tin-silver junctions are replaced by "M" spots 24 at the tin-copper junctions. Since the amalgamation temperature of tin with copper is much higher than that of tin with silver, and the time required for tin to amalgamate with copper is much longer than that of tin with silver, the minimum melting current of the fusible element shown in FIG. 5 will be higher than that of the fusible element of FIG. 4. The portion of the time-current characteristic curve at which this amalgamation is effective is greatly reduced or eliminated entirely where the higher thermal impedance of the link 16 always causes the midpoint of the link 16 to melt before its ends amalgamate with the copper connecting members 22. This is illustrated in FIG. 2, in which a 40-ampere current limiting fuse having fusible elements which are constructed as shown in FIG. 5, with the cross sectional area of the copper connecting member 22 being the same as the largest cross sectional area of the ribbon 18, bu the minimum melt time-current characteristic curve A-B-E-C-G. In such a fuse, only the lowest current, longest time portion C-G of the time-current characteristic curve A-B-E-C-G is determined by the inherent "M" spots 24 at the junctions of the tin link 16 and the copper connecting members 22, or, alternately, depending on the heat dissipating ability of the link 16, the melting characteristics of the link 16 will determine the entire intermediate and low range portions B-E-C-G of the melting time-current characteristic curve A-B-E-C-G at normal ambient operating tempertures. The cross section of each copper connecting member 22 is chosen to be the same as that of each silver ribbon 18 so as not to detrimentally effect the fast rate of burnback during the operation of the fuse.

As seen in FIG. 2, the use of these copper connecting members 22 raises the minimum melting current of a 40-ampere fuse to approximately 62 amperes, as compared with the 50-ampere minimum melting current for a 40-ampere fuse using the fusible element of FIG. 1. Thus, this fuse could be used at a higher continuous current rating if the other elements in the fuse are capable of withstanding the higher quantity of heat generated at the higher rating. However, if the fusible element of FIG. 5 is directly substituted for the fusible element of FIG. 1 in an existing design of a 40-ampere current limiting fuse, the fact that the fuse would have to carry 62 amperes versus 50 amperes for long periods of time could be undesirable if the greater release of heat (52 percent more heat at 62 amperes versus 50 amperes) at the "M" spot area is sufficient to cause thermal degregation of other fuse elements, such as the fusible element support spider or the tubular housing.

Figure 6:
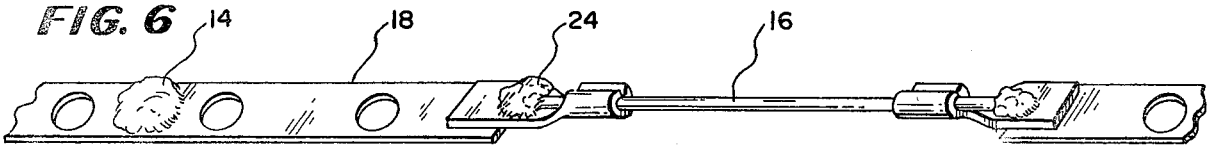
FIG. 6 is a partial perspective view of a fusible element of a current limiting fuse, illustrating another embodiment of the invention.

A simple and practical method of modifying the fusible element of FIG. 5 to reduce its minimum melting current is to use the "M" spot 14 of FIG. 1, consisting of a body of low melting temperature alloy such as lead-tin solder in close proximity to the one of the silver ribbons 18, in addition to the tin link 16 and copper connecting members 22. As can be seen from FIG. 2, the time-current characteristics curve for a 40-ampere fuse using the fusible element of FIG. 1 crosses the time-current characteristics curve of a 40-ampere fuse using the fusible element of FIG. 5 at point C. If a conventional "M" spot 14 is used on one of the fusible ribbons 18 of the fusible element of FIG. 5, this "M" spot 14 will initiate melting of the fusible element in accordance with the time-current characteristics curve C-D of FIG. 2. Thus, a 40-ampere current limiting fuse using the fusible elements of FIG. 6 will have a minimum melt time-current characteristics curve A-B-E-C-D as shown in FIG. 2.

Alternatively, the fusible link of FIG. 5 could be modified to reduce the minimum melting current by using elongated copper connecting members 22 of reduced cross sectional area so that a lower continuous overcurrent is required to raise the temperature of the inherent "M" spot 24 at the juncture of the tin link 16 and the copper connecting members 22 to its amalgamation temperature. Since such a modification of the copper connecting members 22 will also result in faster melting times of the tin link in the intermittent range of the time-current characteristics curve, it may be necessary to increase the diameter of the tin link 16 somewhat to assure that it is capable of withstanding a normal transformer inrush current for which these current limiting fuses are designed. Also, the copper connecting members 22 must have a melt $I^2t$ above that of either the silver ribbons 18 or the tin links 16 so that the time-current characteristics curve is determined only by the fusion points of the silver ribbons 18, the tin link 16, and the "M" spots 24.

Materials other than silver, tin, and copper can be used for the end portions 18, link 16, and connecting members 22 respectively, so long as the link 16 has a lower melting temperature and higher thermal impedance than the end portons 18, and will only amalgamate with a connecting member 22 at a higher amalgamation temperature of longer duration than the amalgamation temperature and time of a conventional "M" spot 14 on one of the end portions 18.

What is claimed is:

1. A fusible element for a high voltage current limiting fuse which comprises:

two end sections of a first metallic conductive material, each end section including a plurality of serially related fusion points of relatively small cross sectional area where fusion of the fuse element is initiated by high magnitude overcurrents of short duration and intermediate portions of relatively large cross sectional area;

a center section of a second metallic conductive material having a lower melting temperature than said first conductive material of said end section, said center section having opposite ends, and said center section having a melt $I^2t$ at least as great as that of said end sections, and having a lower heat dissipating ability than said fusion points of said end sections, so that fusion is initiated at said center section by overcurrents of lower magnitude and longer duration; and two connecting sections of a third metallic conductive material, the amalgamation time and temperature of said second and third materials being much greater than the amalgamation time and temperature of said first and second materials, each connecting section having a melt $I^2t$ greater that said center section, one of said connecting sections being connected between one end of said center section and one of said end sections, and the other of said connecting sections being connected between the opposite end of said center section and the other of said end sections, to thereby connect said end sections in series through said center section.

2. A fusible element, as described in claim 1, wherein said first material of said end sections is silver; said second material of said center section is tin; and said third material of said connecting sections is copper.

3. A fusible element, as described in claim 1, wherein the cross sectional area of each connecting section does not exceed the maximum cross sectional area of one of said end sections.

4. A fusible element, as described in claim 1, which further comprises:

a body of low melting temperature metal in intimate contact with one of said end sections, which forms an "M" spot for initiating fusion of the fusible element at overcurrents of the lowest magnitude and longest duration.

5. A fusible element, as described in claim 1, wherein said center section has a melt $I^2t$ equal to the melt $I^2t$ of said end sections.

* * * * *